United States Patent [19]

Konersmann

[11] 4,123,986

[45] Nov. 7, 1978

[54] THREAD-CUTTER DEVICE FOR DOUBLE LOCK STITCH SEWING MACHINE

[75] Inventor: Alwin Konersmann, Bielefeld, Germany

[73] Assignee: Dürkoppwerke GmbH, Bielefeld, Germany

[21] Appl. No.: 794,619

[22] Filed: May 6, 1977

[30] Foreign Application Priority Data

May 7, 1976 [DE] Fed. Rep. of Germany ... 7614464[U]

[51] Int. Cl.[2] ..... D05B 65/02

[52] U.S. Cl. ..... 112/289; 112/292

[58] Field of Search ..... 112/292, 296, 279, 285, 112/289

[56] References Cited

U.S. PATENT DOCUMENTS

| | | | |
|---|---|---|---|
| 2,902,960 | 9/1959 | Ketterer | 112/289 X |
| 3,783,813 | 1/1974 | Kroll | 112/289 |
| 3,895,591 | 7/1975 | Killinger | 112/289 |

*Primary Examiner*—H. Hampton Hunter
*Attorney, Agent, or Firm*—Karl F. Ross

[57] ABSTRACT

A thread-cutting device for a cyclically operated double lock stitch sewing machine forming part of an automatic sewing system serves to cut the needle and bobbin or looper threads, respectively, at the underside of the throat or stitch plate of the sewing machine in close proximity to the needle hole in the throat or stitch plate. For cutting of the threads, a cutting edge is moved with respect to a stationary cutting blade into a cutting position for simultaneously cutting of the two threads. The carrier for the movable cutting tool moves the stationary cutting blade into its effective cutting position and further carries thread control fingers which assist in preparing the threads for the cutting operation. The cutting mechanism is actuated by the control means for the cyclically operated double lock stitch sewing machine.

6 Claims, 3 Drawing Figures

THREAD-CUTTER DEVICE FOR DOUBLE LOCK STITCH SEWING MACHINE

FIELD OF THE INVENTION

The present invention relates to a cutting mechanism for a cyclically operated double lock stitch sewing machine and, more particularly, to a thread-cutting mechanism arranged at the underside of the throat or stitch plate, in close proximity to the needle opening in the throat or stitch plate, for cutting of the upper or needle thread and the under, bobbin or looper thread in such a sewing machine.

BACKGROUND OF THE INVENTION

In U.S. Pat. No. 3,783,813 it has been proposed to provide a thread-cutting mechanism in which an edge of a stitch plate insert or bushing, forming the needle aperture or hole for passage of the needle therethrough, is formed as a stationary cutting blade which cooperates with a second, movable cutting blade. While with such an arrangement a prime objective of such cutters can be achieved, namely cutting of the upper and lower threads, respectively, leaving short thread ends, some disadvantages arise.

The main disadvantage arises due to the special precautions that need to be taken to avoid accidental cutting of the needle thread portion remaining in the needle eye against the edge of the stitch hole. This end also passes through the needle hole and a special groove must be made for this thread end portion since cutting is carried out at the needle or stitch hole of the throat or stitch plate.

Because the insert or bushing forming the needle hole is subject to considerable wear, caused by the needle and the thread passing therethrough, provision of a cutting edge in such bushing or insert tends to increase this wear and leads to frequent replacement of the needle-hole-forming insert in the throat or stitch plate.

OBJECTS OF THE INVENTION

It is therefore an object of the present invention to provide an improved thread-cutting mechanism for cyclically operated, i.e. stitch-group double lock stitch sewing machines.

Another object of the invention is to provide a thread-cutting system for such sewing machines which is easy to install and operate.

Yet another object is to provide a cutting system for such sewing machines which will minimize the length of the resulting thread ends after severing of the needle and underthreads.

Still another object is to provide a cutting system for a stitch-group double-lock stitch sewing machine which will permit trouble-free upper or needle thread passage through the needle or stitch hole in the throat or stitch plate after cutting of the needle thread.

Still another object of the invention is to provide a thread-cutting system which is easy to operate in conjunction with the cyclic operation of such a sewing machine.

SUMMARY OF THE INVENTION

According to the present invention, a cyclically operated sewing machine, at times also referred to herein as a stitch-group double lock stitch sewing machine (cyclic sewing machine) is provided at the underside of the throat or stitch plate with stationary and movable cutting means, such as cutting edges or blades, mounted on movable or stationary carrying or support means such as movable levers, arms or the like. Thus an actuating lever which is movably attached to the throat-plate comprises a cutting edge carrying clamping and pulling member for bringing a substantially stationary cutting blade provided on a carrying arm, which, in turn is fastened to the underside of the throat plate when the throat-plate is in operating, installed position attached to the sewing machine. The actuating arm carries also a pair of thread control fingers for controlling of the upper and under threads prior to and during the cutting operation.

The carrying arm is rotated about a center in an arcuate motion to bring the movable cutting edge into cutting engagement with the stationary cutting blade. For this, the carrying arm of the stationary cutting blade can be deflected, in a downward direction with respect to the throat plate in installed position, to be in a precisely aligned position for interaction during cutting with the movable cutting edge.

The advantages of the present invention reside for one in the facility with which the two cutting means can be replaced, that is the cutting edges or blades are supported on arms or the like which can be relatively quickly removed and installed again. This is in contrast to a cutting edge, for example, located on a tightly mounted stitch-hole insert in the throat or stitch plate forming.

The interaction between the two cutting means will result in an efficient cutting of the needle thread and the bobbin thread. Thus, undesirable extension or "running-loose" of the bobbin thread supply after cutting of the underthread will be avoided.

Furthermore, the invention reduces the number of moving parts for the respective motions to be carried out thus resulting in a more simple yet effective cutting device.

More particularly, the invention relates to an improvement in a double-lock-stitch stitch-group sewing machine of the type described in the aforementioned patent but provided with a thread-cutting assembly which is intended to replace that of the patent. The improved thread-cutting assembly comprises, as is known from earlier systems, a cutter for the simultaneous cutting of the underthread and a strand of the needle or upper thread in the region of the stitch plate. The cutter comprises a movable first cutter blade displaceable from a neutral (inoperative) position along a recess of the stitch plate on the underside thereof into a cutting (operative) position. The first cutter blade cooperates with a second cutter blade in the region of the stitch hole in this stitch plate. The assembly also comprises a deflecting finger for the looper or underthread and a separating finger penetrating into the upper-thread loop in order to separate the strand to be cut from the upper-thread loop strand which is not to be cut.

The present improvement teaches that the second blade is resiliently mounted in a recess of the stitch plate and that means is provided to deflect this second blade from a position in which its cutting edge lies proximal to the stitch plate (inoperative position) to a cutting position (operative position) in which the cutting edge is spaced further from the stitch plate.

According to a further feature of the invention, the movable first cutter blade forms a member of a thread-drawing and clamping device for the engagement on temporary retention of the upper or needle thread, this clamping member displacing the second blade into its cutting position.

DESCRIPTION OF THE DRAWING

The above and other objects, features and advantages of the present invention will become more readily apparent from the following description, reference being made to the accompanying drawing in which.

SPECIFIC DESCRIPTION

Figure 1:
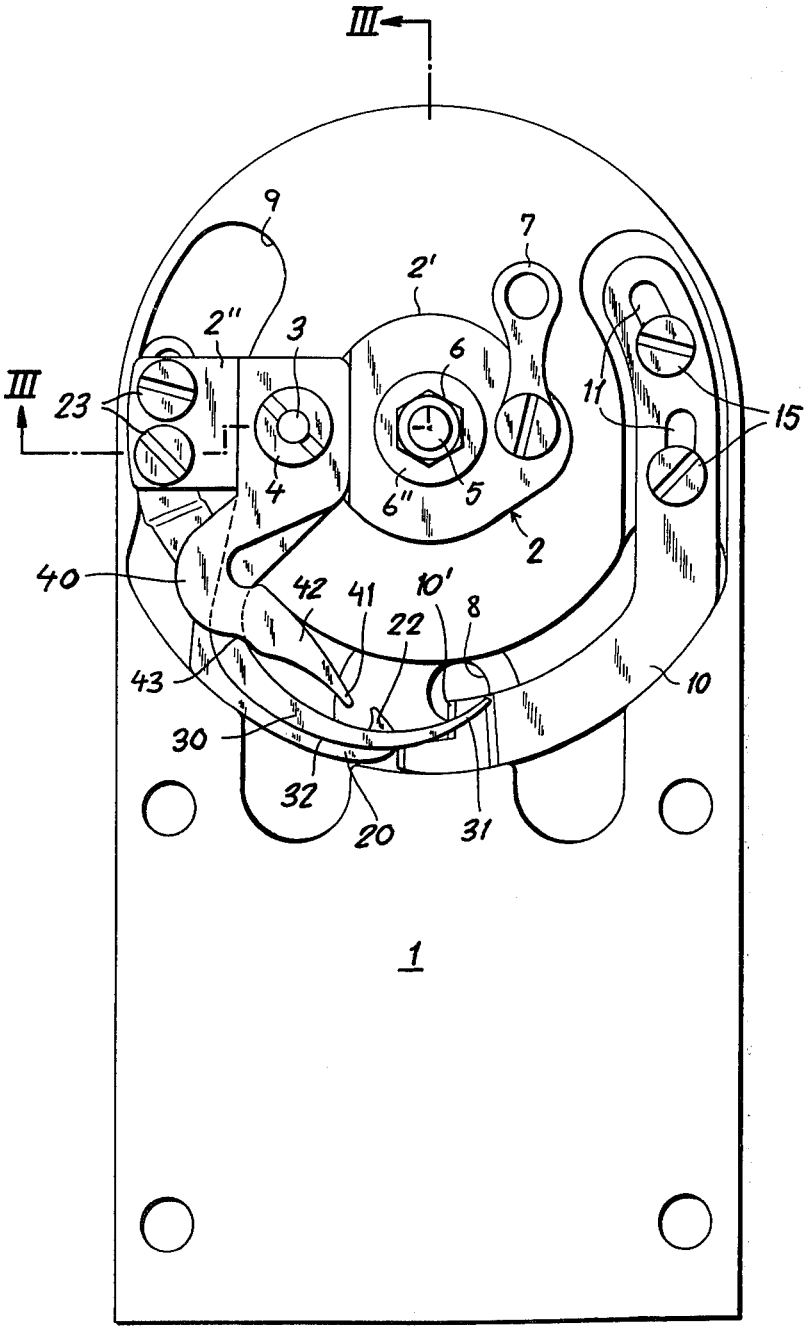
FIG. 1 shows, in plan view, as seen from below, a throat or stitch plate with the thread-cutting mechanism in accordance with the present invention in the rest or inoperative position.
Figure 2:
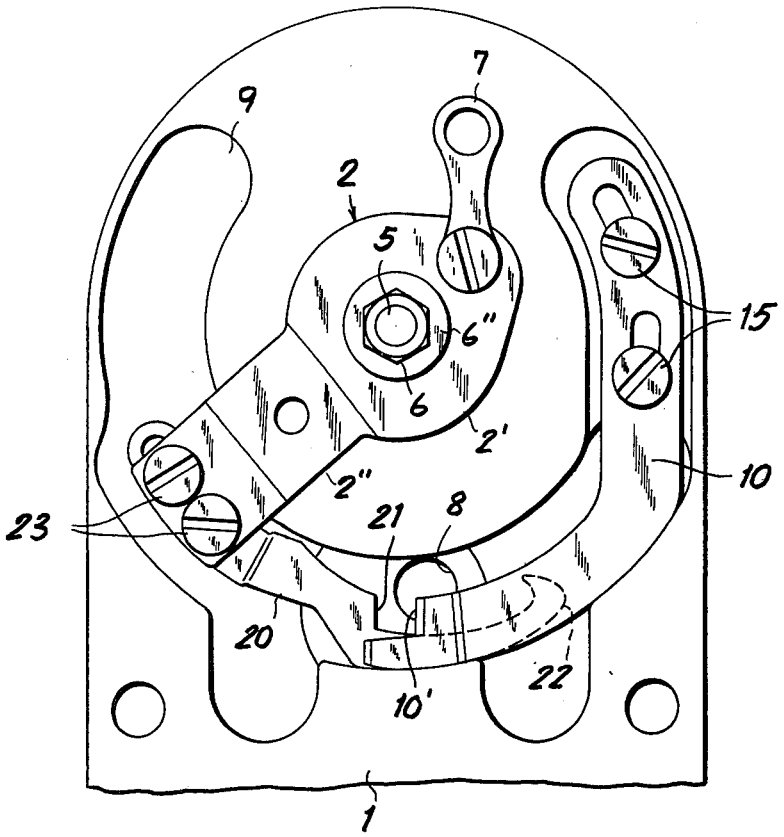
FIG. 2 is a view similar to FIG. 1 showing the thread-cutting mechanism in a position just prior to cutting wherein the deflecting and separating fingers are shown in phantom outline in order to permit a better representation of the action of the cutting tools.

As can best be seen from FIGS. 1 and 2, a throat or stitch plate 1 has a stitch hole 8. The machine may, except for the cutting mechanism, be of the type described in the afore-mentioned patent. The sewing machine for which the cutting device is applicable can be a cyclic sewing machine, e.g. a bar-tacker machine of the double lockstitch type. Throat or stitch plate 1 is provided, in the vicinity of needle hole 8, with a thread-cutting device comprising a cutting blade (second blade)10′ and a cutting edge 21 of a first cutting blade both to be described in greater detail below.

In order to align the respective threads prior to cutting, i.e. the upper or needle thread and the under or bobbin thread, a pair of fingers, namely diverting or deflecting finger 30 and separating finger 40 are provided as well as a thread-drawing and clamping member 20 for pulling and clamping of the upper thread.

The separating finger 40 and the deflecting finger 30 are co-axially fastened by means of a threaded pin 3 and slotted nut 4 on actuating lever 2. Actuating lever 2 is fastened to throat or stitch plate 1 as can best be seen from FIG. 3.

A threaded fastener or pin 5 is mounted on throat or stitch plate 1 to which pin 5 retains bushing 6″ which in turn carries a hub portion 2′ of actuating lever 2. Nut 6 maintains this subassembly in place. As can be seen as well in FIG. 3, arm 2″ of actuating lever 2 has a depression or groove to receive therein the fastening ends of fingers 30 and 40.

As can be seen with reference to FIG. 1 and FIG. 2, a connecting link 7 is provided which is connected with its lower end to the hub portion of actuating lever 2 while its other end is actuated by the sewing machine, not shown in detail, to impart a rotational motion to the actuating lever about the center provided by pin 5. Upon actuating of connecting link 7 attached to the hub portion 2′ of actuating lever 2, the lever will, in turn, cause an arcuate motion to be performed, clockwise and counter-clockwise, by the arm portion 2″ of arm 2 and the thread control fingers 30 and 40 as well as pulling and clamping member 20.

Separating finger 40 is arranged lowermost with respect to the throat-plate, when in installed position. Its function is to separate and sufficiently extend the upper or needle thread loop. It will separate the needle thread into two major portions or strands. For this, finger 40 is inserted into the upper thread loop and separates, as is known in the art, the upper thread loop into a portion or strand leading towards the material to be sewn in the sewing machine (overlying the stitch plate) which portion of the needle thread will be cut subsequent to separating.

The other end or portion of the needle thread loop runs to the needle eye. This portion is moved, as the loop is extended, along the curved outer edge of finger 40. Thus, initially the pointed tip 41 of finger 40 enters the upper thread loop and then the tapered portion 42 of finger 40 expands the loop in order to achieve a sufficient quantity of thread for the actual cutting operation. The relative thread tensioning achieved by this step is now released to some degree since the thread portion to be severed is brought to rest in indentation 43 on finger 40 — just prior to the cutting of the threads. The needle thread is held in indentation 43 so that the severed end will not be subjected to uncontrolled movements.

Deflecting finger 30 is positioned between upper separating finger 40 just described and the thread pulling and clamping member. Diverting or deflecting finger 30 serves to separate the under or bobbin thread, to be cut as well, from the needle thread. For this, sickle-shaped tip 31 of finger 30 engages with the bobbin thread prior to formation of the needle thread loop and guides the bobbin thread on its circumferential outer thread guide edge 32. As can best be seen with reference to FIG. 1, the outer thread guide edge 32 is formed with a relatively large radius so that the guide edge 32 can effectively separate the upper thread and the under thread.

The thread guide fingers just described in some detail are of known configuration and their operation is known in the art as well.

Following separation of upper thread and under thread and apportioning of the needle thread by finger 30 as described earlier, cutting of the threads can be carried out.

The cutting system, in the vicinity of needle hole 8, comprises two main elements. One is a generally stationary, bent arm 10 attached to the underside of the throat plate 1 by way of fasteners 15 communicating with slots 11 to permit adjustment of the arm 10 in groove or recess 9 of throat-plate 1. On arm 10, in close proximity to the needle hole 8, is the cutting blade 10′ which is formed as a sloped cutting edge on the lower end of arm 10. As such arm 10 can be shaped from steel permitting resilient movement of the arm as will be described in further detail below.

Cutting blade 10′ is normally in a rest position close to the underside of throat-plate 1. On actuating the thread control fingers 30 and 40 and also member 20 by means of link 7 and actuating lever 2, the aforementioned tools will swing in counter-clockwise direction through the arcuate path defined by the arm portion of lever 2. Thus, the thread control fingers will carry out the functions described earlier. Member 20 in turn will engage the arm 10 underneath the throat-plate and deflect or lift the arm 10 away from the throat or stitch plate 1 into its cutting position.

Figure 3:
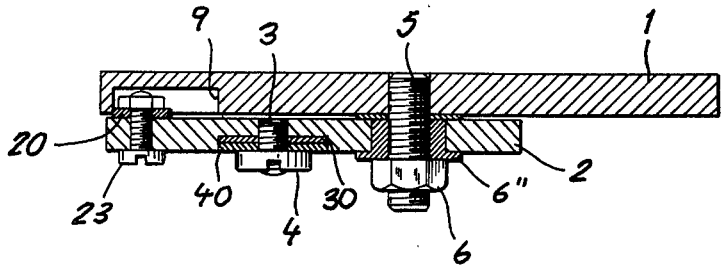
FIG. 3 is a cross-section along line III — III in FIG. 1.

Thread pulling and clamping hook member 20 is attached by fasteners 23, for example screws, to the opposite side, with respect to the thread guide fingers 30 and 40, on the arm portion of actuating lever 2 as can best be seen in FIG. 3. Member 20 has a hook end 22 and a cutting edge 21 generally extending parallel to the main longitudinal axis of the sewing machine.

Thus, as actuating lever 2 moves the various tools into their respective operating positions, hook end 22 will slide between the stationary arm 10 and the underside of the throat-plate and move the latter into cutting position, away from the underside of the throat-plate. Since the member 20 also carries cutting edge 21, a scissor-like cutting action will be performed by cutting edge 21 and blade 10' when the motion of the actuating lever brings the two into overlapping, cutting position. For this the cutting edge 21 is bevelled or sloped to achieve smooth and swift cutting of the threads.

Upon retreat into the position indicated in FIG. 1 of the various tools arranged on actuating lever 2, the starting end of the needle thread, i.e. the needle thread end remaining after cutting, is held in place by hook end 22 until the first few stitches of the subsequent cycle have been completed.

In summary, a thread cutting device is provided which comprises thread control fingers 30 and 40 as well as pulling and clamping member 20 which three tools are commonly mounted on actuating lever 2. Actuating lever 2 is moved, in accordance with the cyclic operation of the sewing machine, in an arcuate path in order to engage the cutting tools 10' and 21 in simultaneous cutting of the needle and under threads, respectively. Prior, during and after the cutting operation the thread control tools carry out their respective functions described earlier. After the threads have been cut, the tools are returned to their rest positions.

I claim:

1. A thread-cutting device attached to the throat plate having a needle hole of a cyclic sewing machine, which comprises:

a substantially stationary arm carrying a first cutting blade in the region of said hole, said arm being attached to the throat plate to permit flexing motion of said arm in a downward direction;

means for imparting a rocking motion controlled by the sewing machine to the thread-cutting device;

an actuating lever connected to said actuating means, said lever having a hub portion and an integral arm portion extending therefrom;

a pair of thread control fingers mounted in superimposed relationship on the arm of said actuating lever adjacent to the hub portion;

a clamping and pulling member attached to the free end of the arm of the actuating lever for flexing said first cutting blade into cutting position; and a second cutting edge on said clamping and pulling member.

2. A thread-cutting device in accordance with claim 1, further comprising means for mounting the actuating lever for arcuate motion to bring the first cutting blade into cutting position.

3. A thread-cutting device in accordance with claim 1, wherein the clamping and pulling member is positioned to move the first cutting blade on said arm downwardly into its cutting position.

4. A thread-cutting device in accordance with claim 1, wherein said clamping and pulling member is guided in a groove formed in the underside of the throat-plate.

5. In a stitch-group double lockstitch sewing machine having a stitch plate provided with a stitch hole traversed by a needle carrying a needle thread through said hole and cooperating with an underthread and provided with a thread-cutting mechanism for the simultaneous cutting of said underthread and a strand of said needle thread in the region of said hole, said thread-cutting mechanism comprising an arcuate recess formed in the underside of said stitch plate, said hole being located along said recess, a movable first blade mounted on the underside of said stitch plate and shiftable in said recess from a position wherein its cutting edge is remote from said hole to a position wherein said cutting edge is proximal to said hole, a second blade fixed to said stitch plate and formed with a cutting edge proximal to said hole and co-operating with said first blade to sever said threads between said edges, a deflecting finger on the underside of said stitch plate for deflecting said underthread, and a separating finger on the underside of said stitch plate and adapted to penetrate into a needle-thread loop therebelow and separate the same into said strand to be cut and another strand, the improvement wherein:

said second blade is resiliently mounted in said recess for movement of the cutting edge of said second blade from an inoperative position in which it lies proximal to said plate transversely to said plate into a cutting position in which said cutting edge of said second blade is spaced below said plate; and means is provided for deflecting said second blade from said inoperative position into said cutting position.

6. The improvement defined in claim 5 wherein said movable first blade is formed with a thread-drawing and clamping member engageable with said needle thread and forming said means for deflecting said blade.

* * * * *